US010833437B2

(12) United States Patent
Huang et al.

(10) Patent No.: US 10,833,437 B2
(45) Date of Patent: Nov. 10, 2020

(54) HIGH-SPEED CONNECTOR ON HIGH-DENSITY MINI VERSION CHIP SIDE

(71) Applicant: DONGGUAN LUXSHARE TECHNOLOGIES CO., LTD, Dongguan, Guangdong Province (CN)

(72) Inventors: Bin Huang, Shenzhen (CN); Tiesheng Li, Shenzhen (CN); Hongji Chen, Shenzhen (CN); Kun Liu, Shenzhen (CN)

(73) Assignee: Dongguan Luxshare Technologies Co., Ltd, Dongguan, Guangdong Province (CN)

( * ) Notice: Subject to any disclaimer, the term of this patent is extended or adjusted under 35 U.S.C. 154(b) by 0 days.

(21) Appl. No.: 16/397,406

(22) Filed: Apr. 29, 2019

(65) Prior Publication Data

US 2019/0372251 A1 Dec. 5, 2019

(30) Foreign Application Priority Data

May 30, 2018 (CN) ..... 2018 2 0826642 U

(51) Int. Cl.
*H01R 12/70* (2011.01)
*H01R 12/58* (2011.01)
*H01R 12/79* (2011.01)

(52) U.S. Cl.
CPC ..... *H01R 12/7023* (2013.01); *H01R 12/58* (2013.01); *H01R 12/79* (2013.01)

(58) Field of Classification Search
CPC ..... H01R 13/6275; H01R 13/6658; H01R 12/7023
See application file for complete search history.

(56) References Cited

U.S. PATENT DOCUMENTS 6,821,139 B1 * 11/2004 Wu ..... H01R 13/6275 439/352
6,926,553 B2 * 8/2005 Wu ..... H01R 9/0515 439/497
7,114,980 B1 * 10/2006 Wu ..... H01R 13/6275 439/352
7,134,914 B1 * 11/2006 Wu ..... H01R 13/5804 439/607.41

(Continued)

*Primary Examiner* — Ross N Gushi
(74) *Attorney, Agent, or Firm* — Birch, Stewart, Kolasch & Birch, LLP

(57) ABSTRACT

The present invention provides a high-speed connector on a high density MINI version chip side, which comprises a board end connector, a wire end connector and a printed circuit board; the board end connector is arranged on the printed circuit board; the board end connector comprises a board end connector shell and a board end connector body arranged in the board end connector shell; the wire end connector comprises a wire end case and a tongue plate fixed to the wire end case; wherein at least one guide piece is extended from the board end connector shell, and the wire end case is provided with at least one guide slot for creating a butt joint with the guide piece. The connector of the present invention utilizes the space of the board end to the maximum extent, solves the problem that the CPU occupies the space of the board end due to the increased size of the heat dissipation module, and can realize high-speed data transmission.

17 Claims, 7 Drawing Sheets

(56) References Cited

U.S. PATENT DOCUMENTS 7,160,135 B1 * 1/2007 Wu ..... H01R 13/512 439/160
7,175,444 B2 * 2/2007 Lang ..... H01R 43/00 439/76.1
7,189,098 B1 * 3/2007 Wu ..... H01R 13/405 439/206
7,226,314 B2 * 6/2007 Lang ..... H01R 13/629 439/607.04
7,226,316 B2 * 6/2007 Wu ..... H01R 13/5825 439/357
7,232,329 B1 * 6/2007 Wu ..... H01R 12/62 439/358
7,238,040 B1 * 7/2007 Wu ..... H01R 13/6275 439/352
7,261,582 B2 * 8/2007 Wu ..... H01R 13/506 439/352
7,267,575 B1 * 9/2007 Hwang ..... H01R 9/034 439/497
7,281,937 B2 * 10/2007 Reed ..... H01R 13/6275 439/352
7,281,938 B1 * 10/2007 Wu ..... H01R 13/6275 439/353
7,291,034 B2 * 11/2007 Wu ..... H01R 9/035 439/358
7,303,438 B2 * 12/2007 Dawiedczyk ..... H01R 12/7005 439/358
7,331,822 B2 * 2/2008 Chen n ..... H01R 23/6873 439/607.01
7,344,409 B2 * 3/2008 Lang ..... H01R 12/7005 439/372
7,410,365 B2 * 8/2008 Wu ..... H01R 13/512 439/358
7,413,461 B2 * 8/2008 Dawiedczyk ..... H01R 13/6275 439/357
7,445,502 B2 * 11/2008 Zhang ..... H01R 13/658 439/607.01
7,445,503 B1 * 11/2008 Zhang ..... H01R 13/41 439/607.01
7,445,504 B1 * 11/2008 Zhang ..... H01R 13/6594 439/607.01
7,448,897 B2 * 11/2008 Dawiedczyk ..... H01R 13/6275 439/357
7,473,124 B1 * 1/2009 Briant ..... H01R 13/6275 439/352
7,491,089 B2 * 2/2009 Lang ..... H01R 12/7005 439/358
7,540,755 B1 * 6/2009 Wu ..... H01R 13/6275 439/352
7,559,800 B2 * 7/2009 Wu ..... H01R 13/6584 439/607.3
7,572,138 B1 * 8/2009 Wu ..... H01R 13/6275 439/352
7,601,010 B1 * 10/2009 Wu ..... H01R 13/6658 439/76.1
7,651,342 B1 * 1/2010 Wu ..... H01R 9/032 439/607.46
7,654,831 B1 * 2/2010 Wu ..... H01R 13/6593 439/76.1
7,666,023 B2 * 2/2010 Wu ..... H01R 13/6275 439/352
7,686,622 B2 * 3/2010 Dawiedczyk ..... H01R 13/6275 439/76.1
7,798,821 B2 * 9/2010 Liu ..... H01R 9/034 439/459
7,803,010 B1 * 9/2010 Hwang ..... H01R 9/032 439/497
7,857,650 B1 * 12/2010 Wu ..... H01R 13/6275 439/352
7,891,986 B2 * 2/2011 Wu ..... H01R 13/512 439/358
7,909,661 B2 * 3/2011 Wu ..... H01R 12/721 439/357
7,938,669 B2 * 5/2011 Li ..... H01R 13/6275 439/352
7,997,909 B2 * 8/2011 Xu ..... H01R 13/6594 439/607.57
7,997,922 B2 * 8/2011 Dawiedczyk ..... H01R 13/6275 439/357
8,152,568 B2 * 4/2012 Wu ..... H01R 13/6658 439/353
8,162,687 B2 * 4/2012 Dawiedczyk ..... H01R 13/6275 439/357
RE43,427 E * 5/2012 Dawiedczyk ..... H01R 13/6275 439/357
8,241,045 B2 * 8/2012 Reed ..... H01R 9/038 439/76.1
8,251,735 B2 * 8/2012 Wu ..... H01R 13/5825 439/353
8,267,713 B2 * 9/2012 Wu ..... H01R 13/6335 439/352
8,292,637 B2 * 10/2012 Wu ..... H01R 13/5825 439/607.55
8,303,325 B2 * 11/2012 Yang ..... H01R 13/635 439/352
8,337,233 B2 * 12/2012 Wu ..... H01R 13/5825 439/345
8,342,881 B2 * 1/2013 Lang ..... H01R 9/038 439/607.01
8,360,799 B2 * 1/2013 Wu ..... H01R 13/6581 439/358
8,382,506 B2 * 2/2013 Reed ..... H01R 13/6275 439/352
8,393,913 B2 * 3/2013 Wu ..... H01R 13/6275 439/345
8,439,704 B2 * 5/2013 Reed ..... H01R 9/038 439/607.06
8,439,706 B2 * 5/2013 Sytsma ..... H01R 13/65802 439/607.46
8,449,312 B2 * 5/2013 Lang ..... H01R 9/038 439/352
8,454,381 B2 * 6/2013 Wu ..... H01R 13/504 439/352
8,475,197 B2 * 7/2013 Zerebilov ..... H01R 13/6275 439/352
8,475,198 B2 * 7/2013 Wu ..... H01R 13/6275 439/352
8,475,199 B2 * 7/2013 Wang ..... H01R 13/6335 439/160
8,480,432 B2 * 7/2013 Wu ..... H01R 13/5812 439/353
8,506,331 B2 * 8/2013 Wu ..... H01R 13/6658 439/353
8,523,598 B2 * 9/2013 Wu ..... H01R 13/6658 439/352
8,537,558 B2 * 9/2013 Su ..... H01R 9/032 361/740
8,550,848 B2 * 10/2013 Wu ..... H01R 13/6583 439/353
8,668,515 B2 * 3/2014 Wu ..... H01R 13/633 439/352
8,708,752 B2 * 4/2014 Wu ..... H01R 9/032 439/660
8,740,637 B2 * 6/2014 Wang ..... H01R 13/6335 439/352
8,770,990 B2 * 7/2014 Sytsma ..... H01R 9/034 439/76.1
8,851,906 B2 * 10/2014 Wu ..... H01R 13/6581 439/607.45
8,858,240 B2 * 10/2014 Wu ..... H01R 13/6658 439/607.45
8,905,777 B2 * 12/2014 Zhu ..... H01R 13/62 439/352
8,926,339 B2 * 1/2015 Houtz ..... H01R 13/5045 439/76.1
8,979,553 B2 * 3/2015 Lloyd ..... H01R 12/53 439/76.1
9,017,091 B2 * 4/2015 Zhu ..... H01R 13/512 439/352

(56) References Cited

U.S. PATENT DOCUMENTS 9,160,106 B2 * 10/2015 Kuang ..... H01R 13/6275
9,293,839 B2 * 3/2016 Nagamine ..... H01R 13/52
9,331,418 B2 * 5/2016 Chung ..... H01R 13/514
9,385,450 B2 * 7/2016 Wu ..... H01R 12/52
9,385,466 B2 * 7/2016 Henry ..... H01R 13/506
9,385,472 B2 * 7/2016 Yen ..... H01R 13/6275
9,419,367 B2 * 8/2016 Henry ..... H01R 9/034
9,553,394 B2 * 1/2017 Lee ..... H01R 13/506
9,742,132 B1 * 8/2017 Hsueh ..... H01R 24/60
9,774,146 B2 * 9/2017 Cheng ..... H01R 13/665
10,084,271 B2 * 9/2018 Xing ..... H01R 24/60
10,096,944 B2 * 10/2018 Huang ..... H01R 13/4226
10,205,256 B2 * 2/2019 Wu ..... H01R 12/79
10,263,349 B2 * 4/2019 Phillips ..... H01R 12/7029
10,270,191 B1 * 4/2019 Li ..... H01R 12/62
10,381,783 B2 * 8/2019 Zhou ..... H01R 24/60
10,431,932 B1 * 10/2019 Zhang ..... H01R 13/6594
10,431,935 B2 * 10/2019 Huang ..... H01R 13/64
2005/0026500 A1 * 2/2005 Ji ..... H01R 13/6582
439/607.01
2006/0019525 A1 * 1/2006 Lloyd ..... G02B 6/4277
439/352
2006/0134993 A1 * 6/2006 Dawiedczyk ..... H01R 13/6275
439/676
2006/0160399 A1 * 7/2006 Dawiedczyk ..... H01R 13/6275
439/374
2006/0160429 A1 * 7/2006 Dawiedczyk ..... H01R 12/7005
439/676
2006/0189180 A1 * 8/2006 Lang ..... H01R 43/00
439/76.1
2006/0189199 A1 * 8/2006 Lang ..... H01R 12/7005
439/374
2006/0189211 A1 * 8/2006 Lang ..... H01R 13/629
439/607.04
2007/0105410 A1 * 5/2007 Wu ..... H01R 13/506
439/76.1
2007/0155217 A1 * 7/2007 Wu ..... H01R 13/512
439/353
2007/0155218 A1 * 7/2007 Wu ..... H01R 9/035
439/358
2007/0161281 A1 * 7/2007 Wu ..... H01R 13/6275
439/352
2007/0173118 A1 * 7/2007 Chen ..... H01R 23/6873
439/607.01
2008/0020640 A1 * 1/2008 Zhang ..... H01R 23/6873
439/607.01
2008/0032541 A1 * 2/2008 Reed ..... H01R 13/6275
439/352
2008/0085633 A1 * 4/2008 Dawiedczyk ..... H01R 13/6275
439/583
2008/0166899 A1 * 7/2008 Lang ..... H01R 12/7005
439/64
2008/0194136 A1 * 8/2008 Aihara ..... H01R 13/6456
439/378
2009/0124124 A1 * 5/2009 Huang ..... H01R 13/6582
439/607.02
2009/0197438 A1 * 8/2009 Liu ..... H01R 9/034
439/76.1
2009/0247017 A1 * 10/2009 Wu ..... H01R 13/502
439/660
2009/0253292 A1 * 10/2009 Wu ..... H01R 13/512
439/493
2010/0015851 A1 * 1/2010 Wu ..... H01R 13/514
439/607.01
2010/0091466 A1 * 4/2010 Wu ..... G06K 13/08
361/747
2010/0091467 A1 * 4/2010 Wu ..... H01R 13/6335
361/747
2010/0130063 A1 * 5/2010 Lang ..... H01R 13/6658
439/607.17
2010/0203754 A1 * 8/2010 Li ..... H01R 13/6275
439/345
2010/0210131 A1 * 8/2010 Reed ..... H01R 13/6275
439/352
2010/0248544 A1 * 9/2010 Xu ..... H01R 13/6658
439/607.04
2011/0045702 A1 * 2/2011 Su ..... H01R 9/032
439/607.56
2011/0059645 A1 * 3/2011 Wu ..... H01R 9/032
439/460
2011/0086548 A1 * 4/2011 Wu ..... H01R 9/032
439/607.41
2011/0136368 A1 * 6/2011 Wu ..... H01R 13/506
439/345
2011/0195586 A1 * 8/2011 Wu ..... H01R 13/512
439/152
2011/0195590 A1 * 8/2011 Wu ..... H01R 13/6581
439/345
2011/0195595 A1 * 8/2011 Wu ..... H01R 13/6275
439/370
2011/0195614 A1 * 8/2011 Wu ..... H01R 13/512
439/676
2011/0237112 A1 * 9/2011 Wu ..... H01R 13/6275
439/358
2011/0250778 A1 * 10/2011 Wu ..... H01R 13/516
439/345
2011/0281455 A1 * 11/2011 Wu ..... H01R 13/5825
439/345
2011/0294333 A1 * 12/2011 Wu ..... H01R 13/6275
439/345
2011/0300735 A1 * 12/2011 Wu ..... H01R 13/6275
439/345
2011/0300749 A1 * 12/2011 Sytsma ..... H01R 13/65802
439/607.01
2011/0306228 A1 * 12/2011 Wu ..... H01R 13/5825
439/345
2011/0306244 A1 * 12/2011 Zhang ..... H01R 9/034
439/624
2012/0015544 A1 * 1/2012 Wu ..... H01R 13/6275
439/345
2012/0015545 A1 * 1/2012 Wu ..... H01R 13/5825
439/345
2012/0040550 A1 * 2/2012 Wu ..... H01R 13/6275
439/352
2012/0040552 A1 * 2/2012 Wu ..... H01R 13/6581
439/358
2012/0064750 A1 * 3/2012 Wu ..... H01R 13/5812
439/345
2012/0064779 A1 * 3/2012 Wu ..... H01R 9/032
439/676
2012/0129396 A1 * 5/2012 Wang ..... H01R 12/515
439/607.01
2012/0156900 A1 * 6/2012 Wu ..... H01R 13/504
439/76.1
2012/0156938 A1 * 6/2012 Zhang ..... H01R 13/6461
439/660
2012/0171903 A1 * 7/2012 Wang ..... H01R 13/508
439/660
2012/0184126 A1 * 7/2012 Chen ..... H01R 13/504
439/345
2012/0214324 A1 * 8/2012 Wu ..... H01R 13/6658
439/271
2012/0214345 A1 * 8/2012 Wu ..... H01R 13/6583
439/607.19
2013/0095676 A1 * 4/2013 Wu ..... H01R 9/2408
439/76.1
2013/0203293 A1 * 8/2013 Zhu ..... H01R 13/512
439/620.22
2014/0322933 A1 * 10/2014 Li ..... H01R 13/5845
439/76.1
2016/0064873 A1 * 3/2016 Bucher ..... H01R 12/7076
385/88
2018/0145448 A1 * 5/2018 Munch ..... A63H 33/042
2018/0212364 A1 * 7/2018 Huang ..... H01R 13/64
2018/0269607 A1 * 9/2018 Wu ..... H01R 12/79
2018/0366875 A1 * 12/2018 Shinder-Lerner .... H01R 13/631

(56) References Cited

U.S. PATENT DOCUMENTS

2019/0074616 A1* 3/2019 Hou ..... H01R 12/716
2019/0296495 A1* 9/2019 Zhou ..... H01R 12/57

* cited by examiner

HIGH-SPEED CONNECTOR ON HIGH-DENSITY MINI VERSION CHIP SIDE

CROSS-REFERENCE TO RELATED APPLICATIONS

This non-provisional application claims priority under 35 U.S.C. § 119(a) on Patent Application No. 201820826642.0 filed in P.R. China on May 30, 2018, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

TECHNICAL FIELD

The present invention relates to a connector, in particular to a high-speed connector on the chip side of a high-density MINI version.

BACKGROUND ART

With the increase of the network age, the requirements on data processing and transmission speed are increased, the performance and device density of the corresponding servers, workstations and CPUs in the I/O memory are synchronously improved, and certain challenges are brought to the device size and the heat dissipation of the servers. Generally, the heat sink occupies a large space on the printed circuit board, and the space between the heat sink and the printed circuit board in the height direction is small, such that the conventional connector cannot be arranged below the heat sink, and it is difficult to utilize the redundant space below the heat sink, resulting in wasted space of the printed circuit board is wasted.

DISCLOSURE OF THE PRESENT INVENTION

The present invention provides a high-speed connector on a high-density MINI version chip side, which has small size and the height of less than 3.7 mm, can be placed under a heat sink of a chip, and has the transmission speed up to 56 Gbit/s. The space of the board end is utilized to the maximum extent, and the problem that the CPU occupies the space of the board end due to the size expansion of the radiating module is solved.

To achieve the above object, the present invention provides a high-speed connector on a high-density MINI version chip side, comprising: a board end connector, a wire end connector and a printed circuit board; the board end connector is arranged on the printed circuit board; the board end connector comprises a board end connector shell and a board end connector body arranged in the board end connector shell; the wire end connector comprises a wire end case and a tongue plate fixed to the wire end case; wherein at least one guide piece extends from the board end connector shell, and the wire end case is provided with at least one guide slot for creating a butt joint with the guide piece.

The present invention also provides a printed circuit board layout structure, comprising: a connector, a chip and a heat sink arranged on the chip, the connector is arranged below the heat sink, the connector comprises: a board end connector, a wire end connector and a printed circuit board; the board end connector is arranged on the printed circuit board; the board end connector comprises a board end connector shell and a board end connector body arranged in the board end connector shell; the wire end connector comprises a wire end case and a tongue plate fixed to the wire end case; wherein at least one guide piece extends from the board end connector shell, and the wire end case is provided with at least one guide slot for creating a butt joint with the guide piece.

The beneficial effects of the present invention are: the space of the board end is utilized to the maximum extent, the problem that the CPU occupies the space of the board end due to the increased size of the heat dissipation module is solved, and high-speed data transmission can be realized.

The present invention will be described in detail below with reference to the following drawings and embodiments, but the present invention is not limited thereto.

LIST OF THE REFERENCE NUMERALS

Figure 1:
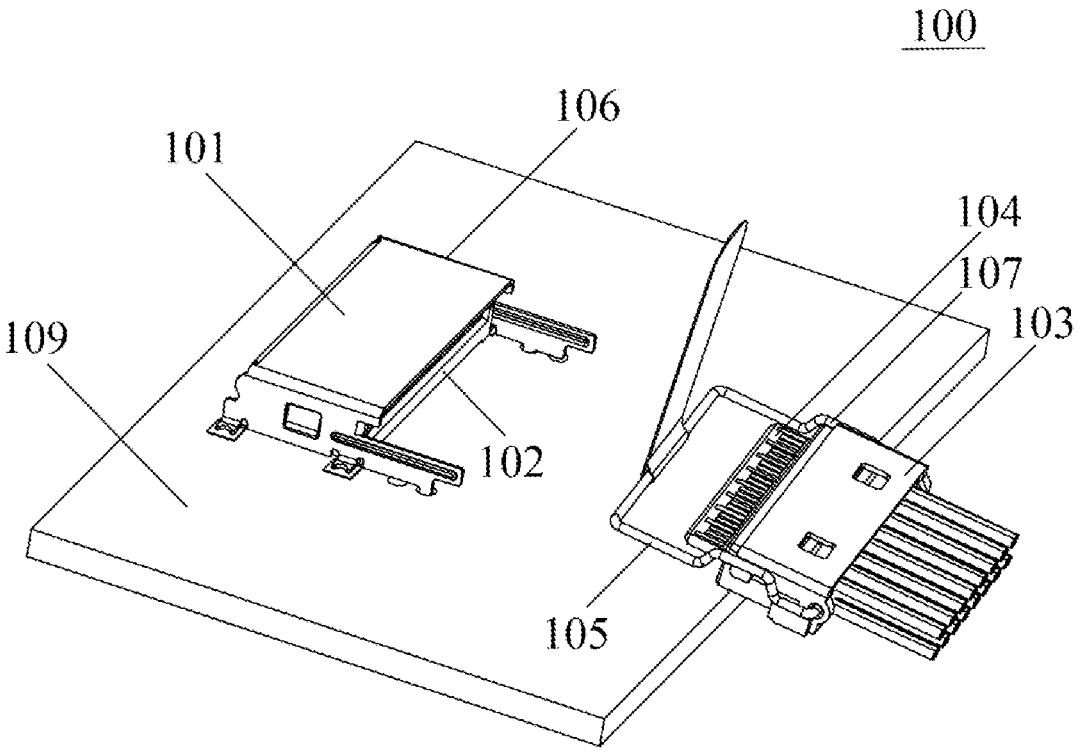
FIG. 1 is a perspective view of the connector of the present invention in a separated state.

100 Connector
101 Board end connector shell
102 Board end connector body
103 Wire end case
104 Tongue plate
105 Unlocking snap
106 Board end connector
107 Wire end connector
109 Printed circuit board
110 Guide piece
111 Guide projection
112 Guide slot
113 Welding foot
114 Snap slot
115 Slot
116 Step
117 Conductive terminal
118 Conductive plastic

DETAILED DESCRIPTION OF THE EXEMPLARY EMBODIMENTS

The structural principle and the operational principle of the present invention will be described in detail below with reference to the attached drawings:

FIG. 1 is a perspective view showing the connector of the present invention in separated state. As shown in FIG. 1, the high-speed connector 100 on high density MINI version chip side of the present invention includes a board end connector 106, a wire end connector 107 and a printed circuit board 109. Both of the board end connector 106 and the wire end connector 107 are used cooperatively.

The board end connector 106 is mounted on the printed circuit board 109 and comprises a board end connector shell 101 and a board end connector body 102 embedded in the board end connector shell 101.

The wire end connector 107 comprises a wire end case 103, a tongue plate 104, a wire end body (not shown) and an unlocking snap 105. The tongue plate 104 is covered by the wire end body, the wire end case 103 covers the wire end body and is fixed to the wire end body, and the unlocking snap 105 is arranged at both sides of the wire end case 103.

Figure 2:
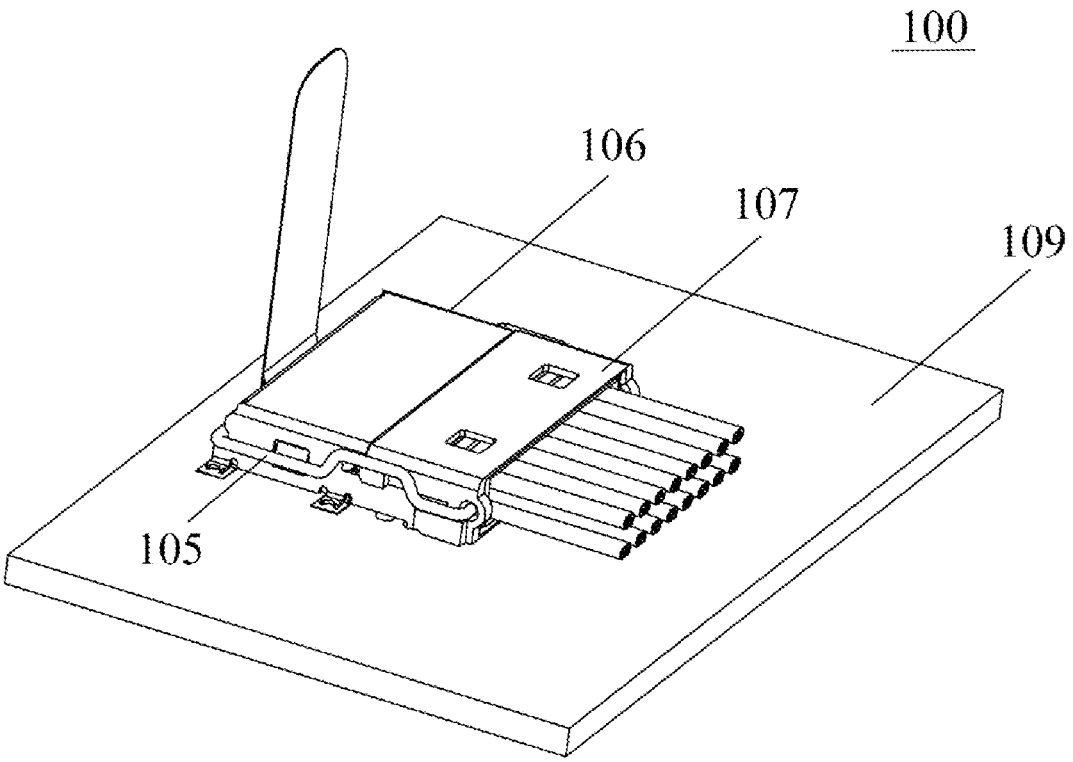
FIG. 2 is a perspective view of the connector of the present invention in a use state.

FIG. 2 is a perspective view showing the connector of the present invention in a use state. As shown in FIG. 2, when using, the wire end connector 107 is aligned with the board end connector 106 and inserted into the board end connector 106, and the unlocking snap 105 is pressed after insertion, such that the wire end connector 107 and the board end connector 106 can be tightly combined.

Figure 3:
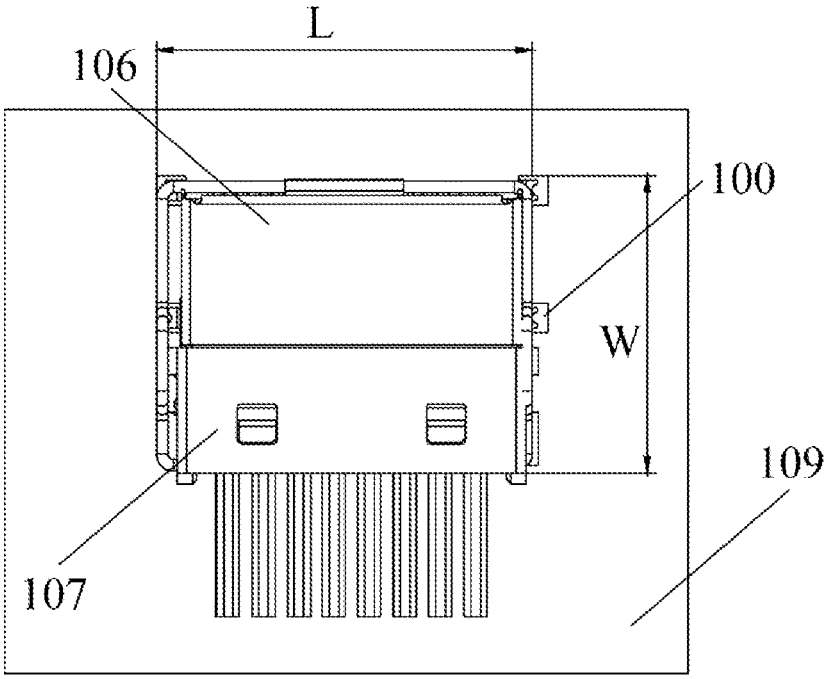
FIG. 3 is a schematic top view of the connector of the present invention.

FIG. 3 is a schematic top view of the connector of the present invention. As shown in FIG. 3, the connector 100 of the present invention has a body portion of a length L, preferably 18-20 mm, and a width W, preferably 13-15 mm, after the wire end connector 107 is coupled to the board end connector 106.

Figure 4:
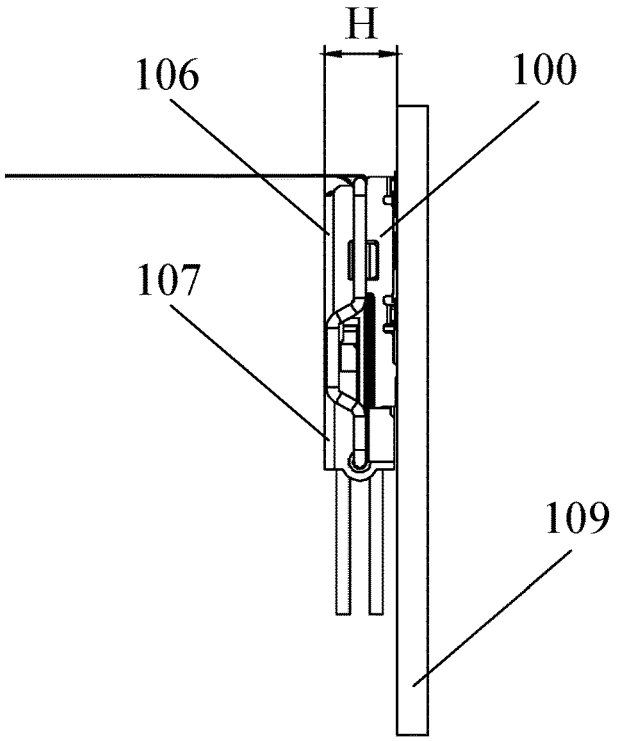
FIG. 4 is a schematic side view of the connector of the present invention.

FIG. 4 is a schematic side view of the connector of the present invention. As shown in FIG. 4, the connector 100 of the present invention has a body portion of a thickness H less than 3.7 mm, after the wire end connector 107 is coupled to the board end connector 106.

Figure 5:
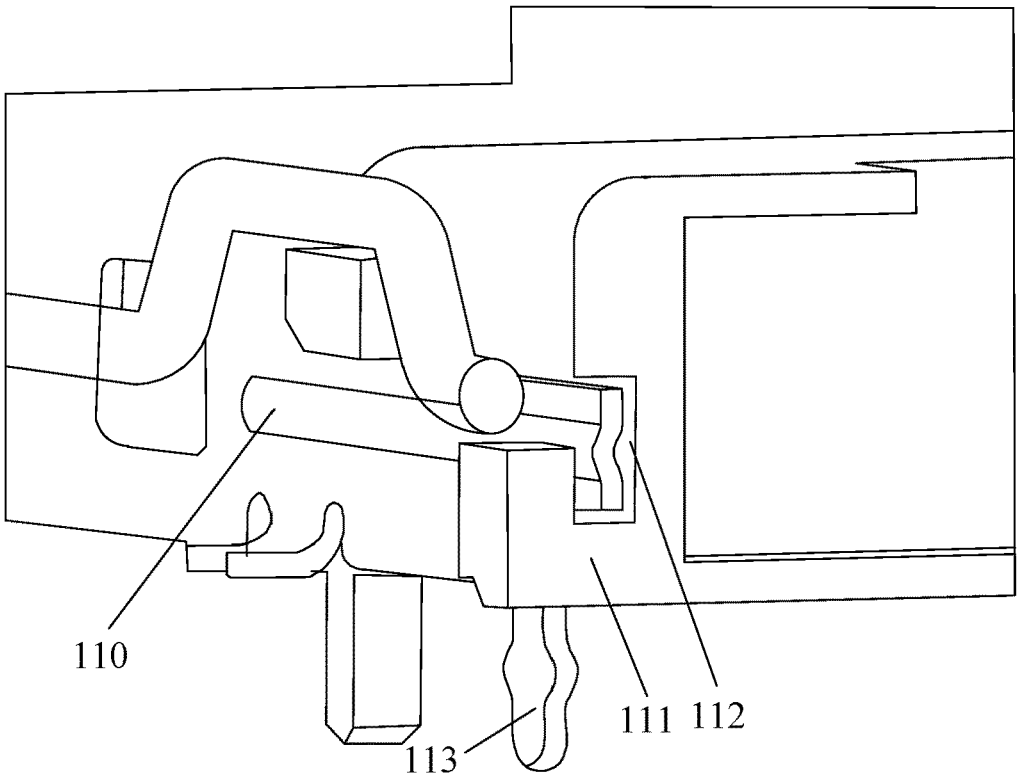
FIG. 5 is an enlarged schematic view of the connected portions of the connector of the present invention.

FIG. 5 is an enlarged schematic view of the connected portions of the connector of the present invention. As shown in FIG. 5, both sides of the board end connector shell 101 are provided with two guide pieces 110 extending outwards from the board end connector 106, and the guide pieces 110 are integrally formed with the board end connector shell 101. Both sides of the wire end case 103 have at least one guide projection 111 extending outward, and the guide projection 111 is integrally formed with the wire end case 103. Both side surfaces of the wire end case 103 have guide slots 112 recessed toward each other. The guide projection 111 is disposed at an edge of the guide slot 112, and the guide projection 111 surrounds at least a portion of the guide slot 112.

When inserting the wire end connector 107 into the board end connector 106, the wire end connector 107 should be inserted into the board end connector 106 after aligning the two guide pieces 110 of the board end connector 106 with the guide slots 112 of the wire end connector 107. During the plugging process, the guide pieces 110, the guide projection 111 and the guide slots 112 are matched with each other, to provide a plugging alignment mechanism for the wire end connector 107 and the board end connector 106, and prevent improper plugging in the wrong direction.

When the wire end connector 107 is inserted into the board end connector 106, the guide piece 110 is inserted into the guide slot 112, such that the guide piece 110 is disposed between the wire end case 103 and the guide projection 111, the guide projection 111 located on both sides of the guide piece 110 abuts against the guide piece 110, so it is possible to prevent the wire end connector 107 from applying an improper force in a direction other than the abutting direction due to the wire bending, and to reduce the damage when the board end connector 106 is butt jointed with the wire end connector 107.

In addition, a welding foot 113 is disposed at one end of the guide piece 110, and the welding foot 113 is formed by the extension of the guide piece 110 and is integrally formed with the guide piece 110. The welding foot 113 is inserted on the printed circuit board 109 and can serve to fix the guide piece 110 to enhance the fixing strength of the guide piece 110.

Figure 6:
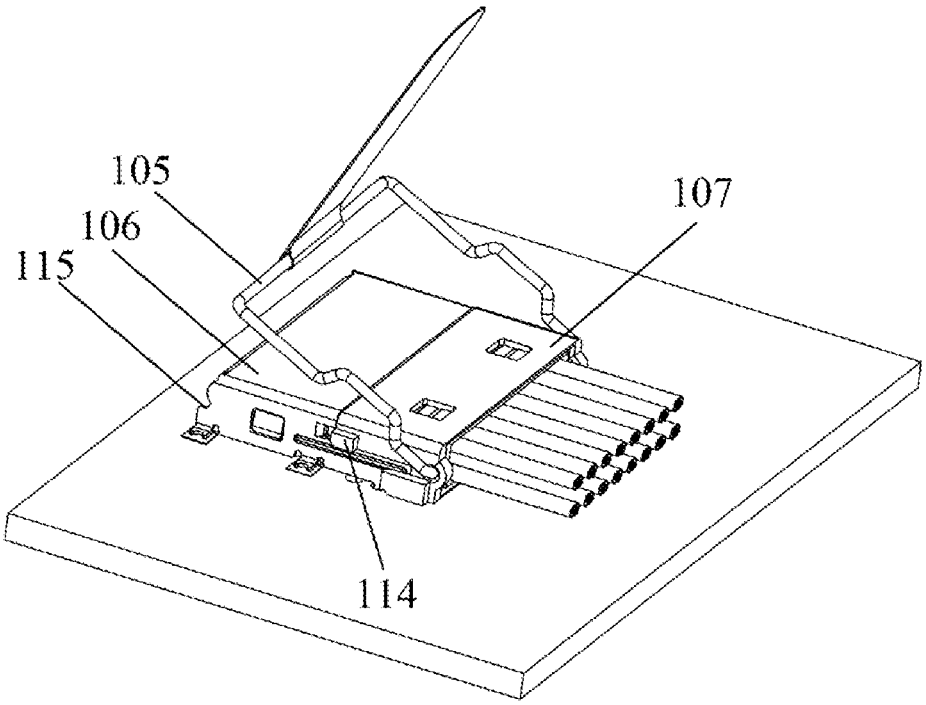
FIG. 6 is a partial schematic view of the unlocking snap portion of the connector of the present invention.

FIG. 6 is a schematic view of the unlocking snap portion of the connector of the present invention. The wire end case 103 is provided with snap slots 114 at both sides of the outside of the wire end case, and the rear end of the board end connector shell 101 is provided with a slot 115. After the wire end connector 107 is inserted into the board end connector 106, the unlocking snap 105 is pressed such that the unlocking snap 105 is snapped into the slot 115, the snap slot 114 is abutted against the unlocking snap 105, and the guide piece 110 is accommodated in the guide slot 112. Because the guide piece 110 fastens the wire end case 103 of the wire end connector 107, the wire end connector 107 may lower the displacement in the direction of the vertical butt joint, in which the guide projection 111 and the snap slot 114 are disposed on both sides of the guide piece 110. Due to the design of disposing the guide projection 111 and the snap slot 114 on both sides of the guide piece 110, it is possible to prevent the movement of the wire end connector 107 caused by the excessive bending of the wire on the side of the wire end connector 107 and also prevent the connector from being warped upward thereby resulting in damage.

Figure 7:
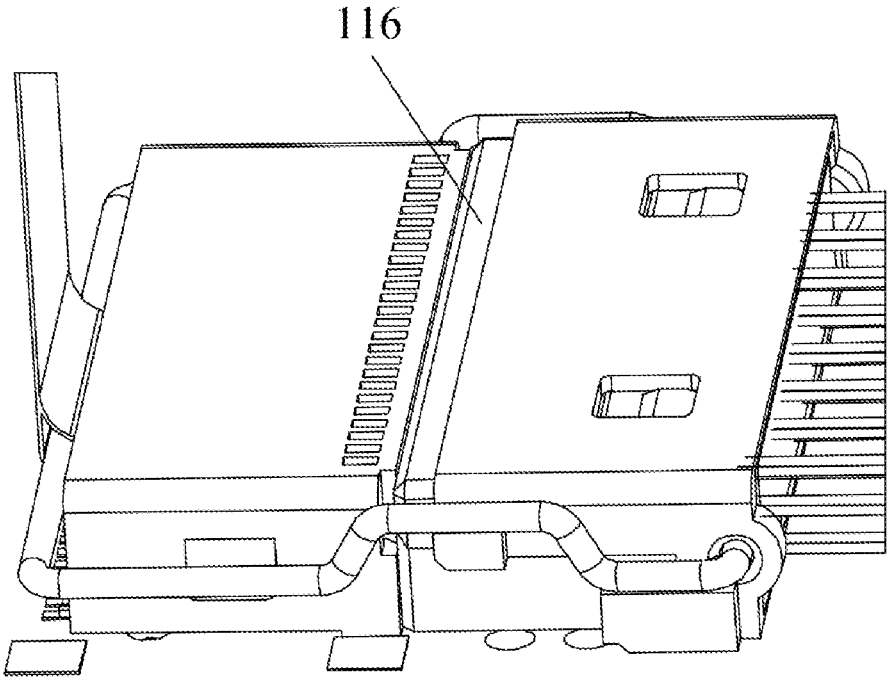
FIG. 7 is an enlarged schematic view of the engagement portion of the connector of the present invention.

FIG. 7 is an enlarged schematic view of the engagement portion of the connector of the present invention. As shown in FIG. 7, a step 116 is disposed on a portion of the upper surface of the wire end case 103, which is combined with the board end connector 106, such that after the wire end connector 107 is combined with the board end connector 106, a portion of the wire end case 103 is embedded in the board end connector shell 101 to form an overlapping portion, which can prevent the peripheral circuit or device from interfering with the connector.

Figure 8:
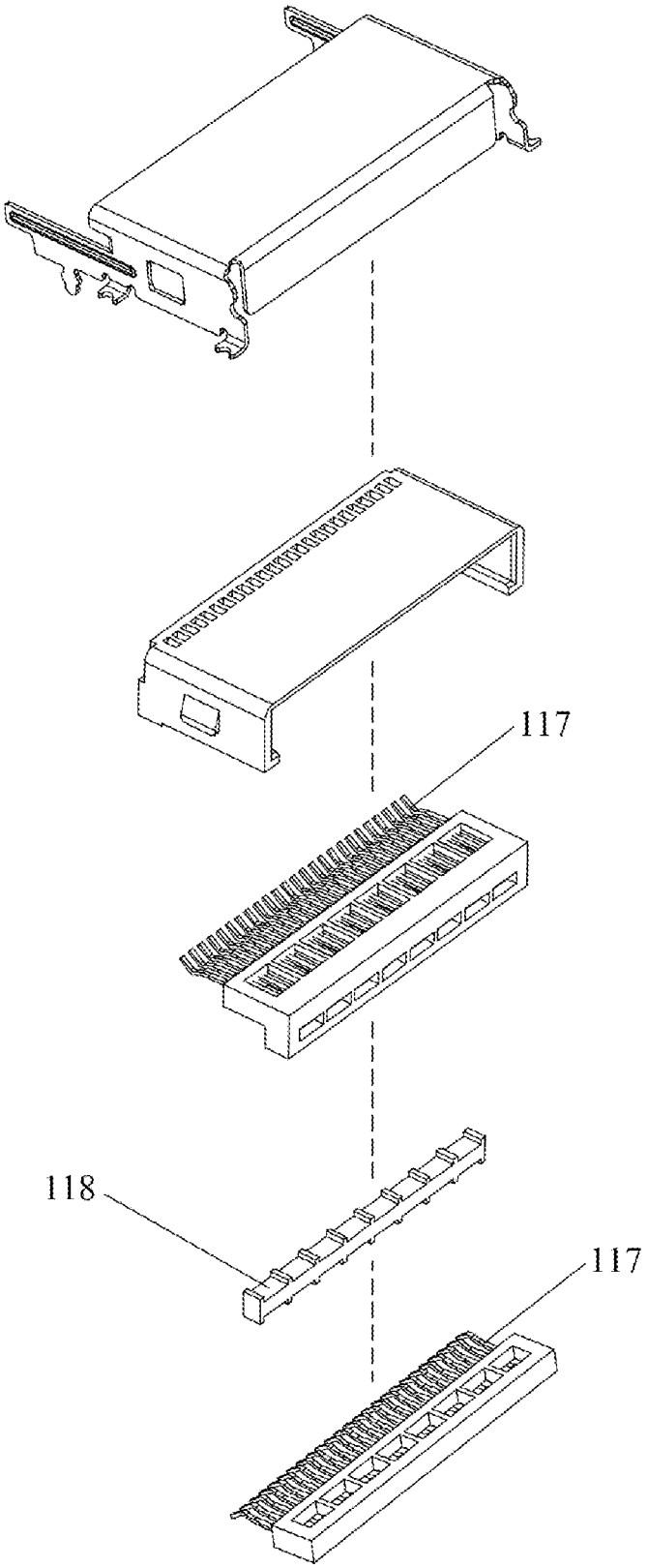
FIG. 8 is an exploded view of the board end connector of the present invention.

FIG. 8 is an exploded view of the board end connector of the present invention. As shown in FIG. 8, the board end connector 106 includes an upper layer and a lower layer of terminals 117 with a conductive plastic 118 disposed therebetween for optimizing the signal integrity resonance of the connector.

Figure 9:
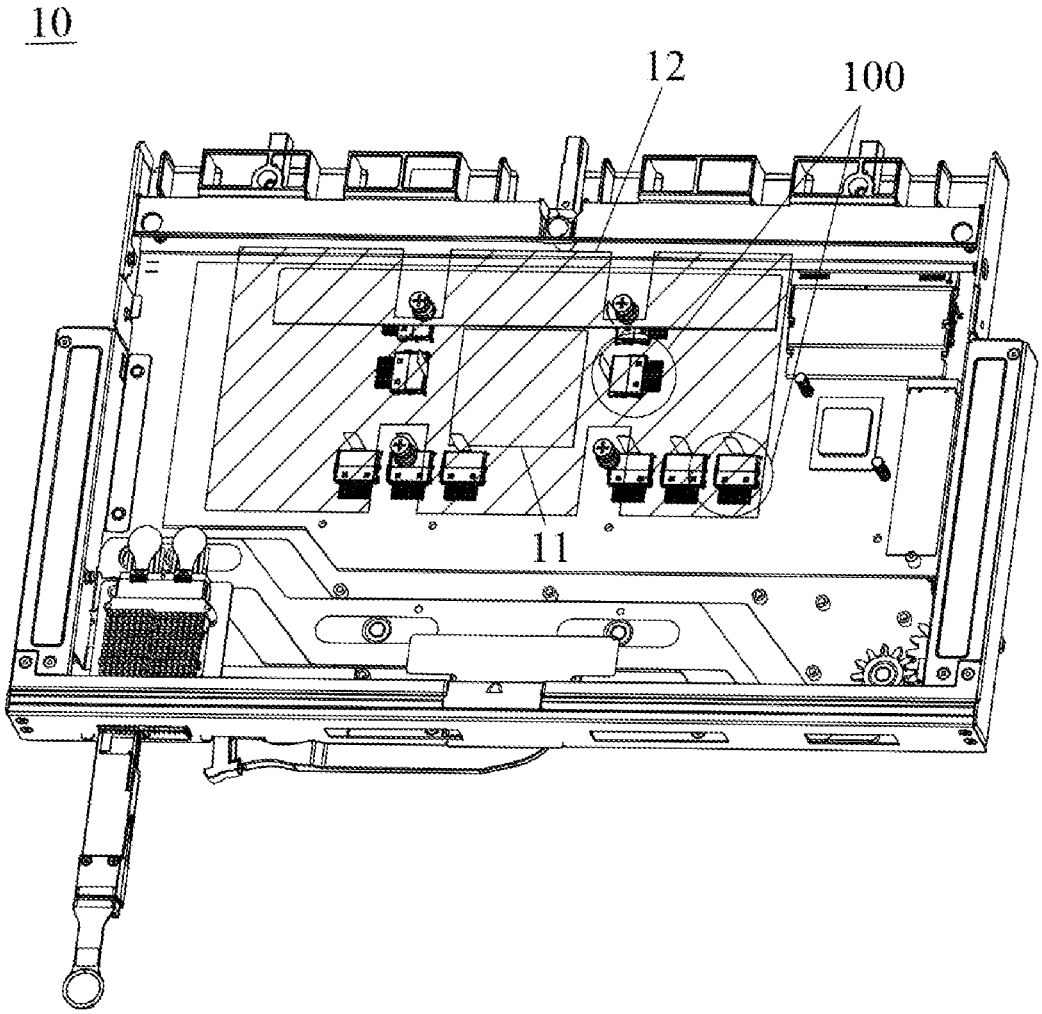
FIG. 9 is a schematic diagram of a system using the connector of the present invention.

FIG. 9 is a schematic diagram of a system using the connector of the present invention. As shown in FIG. 9, the system 10 using the connector 100 of the present invention includes a chip 11, a heat dissipation module 12, and the connector 100. As shown, the connector 100 is disposed below the heat dissipation module 12 and is disposed at a side of the chip 11. Therefore, the space below the heat dissipation module 12 can be fully utilized, the space of the printed circuit board is utilized to the maximum extent, and the problem that the CPU occupies the space due to the increased size of the heat dissipation module is solved.

Figure 10:
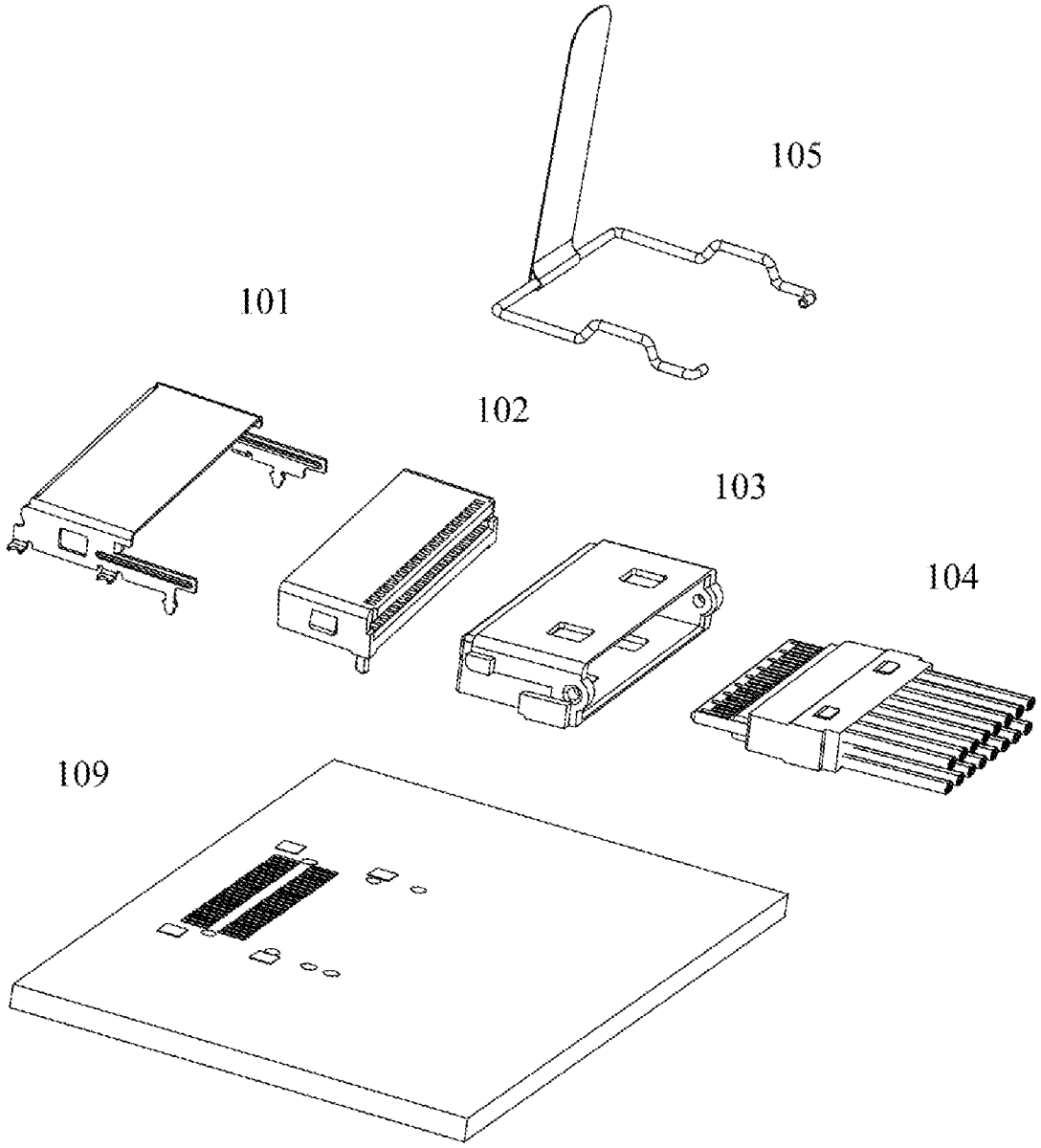
FIG. 10 is an exploded view of the connector of the present invention.

FIG. 10 is an exploded view of the connector of the present invention. Its specific structure has been explained and the same contents will not be repeated.

The present invention may be embodied in other forms, various changes and modifications may be made by one skilled in the art without departing from the spirit or essence of the invention, and the corresponding changes and modifications will fall into the scope of the invention as defined by the appended claims.

The invention claimed is:

1. A high speed connector on high density MINI version chip side, comprises:

a board end connector, and a wire end connector, wherein the board end connector comprises a board end connector shell and a board end connector body arranged in the board end connector shell, wherein the wire end connector comprises a wire end case, a tongue plate and a wire end body cladding the tongue plate, and the wire end body is clad by the wire end case, wherein at least one guide piece is extended from the board end connector shell, and the wire end case is provided with at least one guide slot for creating a butt joint with the guide piece, and wherein the guide slot has an opening facing toward the board end connector and being for the guide piece insertion, and the guide piece comprises at least one welding foot for being inserted in a printed circuit board.

2. The high speed connector on high density MINI version chip side of claim 1, wherein an edge of the guide slot is provided with at least one guide projection.

3. The high speed connector on high density MINI version chip side of claim 2, wherein the guide projection is formed by an extension of the wire end case and surrounds at least a portion of the guide slot.

4. The high speed connector on high density MINI version chip side of claim 2, wherein the guide piece is disposed between the at least one guide projection and the wire end case.

5. The high speed connector on high density MINI version chip side of claim 2, wherein the board end connector shell and the wire end case on the printed circuit board each has a height less than 3.7 mm.

6. The high speed connector on high density MINI version chip side of claim 1, wherein the board end connector shell covers a portion of the wire end case.

7. The high speed connector on high density MINI version chip side of claim 1, wherein the wire end case is provided with an unblocking snap to be buckled with the board end connector shell.

8. The high speed connector on high density MINI version chip side of claim 1, wherein two guide pieces are arranged on both sides of the board end connector shell, respectively, and two guide slots are arranged on both sides of the wire end case, respectively.

9. A printed circuit board layout structure, comprises:

a connector, a chip and a heat sink arranged on the chip, the connector arranged below the heat sink and comprising:

a board end connector, a wire end connector and a printed circuit board, wherein the board end connector is arranged on the printed circuit board, wherein the board end connector comprises a board end connector shell and a board end connector body arranged in the board end connector shell, wherein the wire end connector comprises a wire end case and a tongue plate fixed to the wire end case;

wherein at least one guide piece is extended from the board end connector shell, and the wire end case is provided with at least one guide slot for creating a butt joint with the guide piece.

10. The printed circuit board layout structure of claim 9 wherein the guide piece comprises at least one welding foot inserted on the printed circuit board.

11. The printed circuit board layout structure of claim 9, wherein an edge of the guide slot is provided with at least one guide projection.

12. The printed circuit board layout structure of claim 11, wherein the guide projection is formed by an extension of the wire end case and surrounds at least a portion of the guide slot.

13. The printed circuit board layout structure of claim 11, wherein the guide piece is disposed between the at least one guide projection and the wire end case.

14. The printed circuit board layout structure of claim 11, wherein the board end connector shell and the wire end case on the printed circuit board each has a height less than 3.7 mm.

15. The printed circuit board layout structure of claim 9, wherein the board end connector shell covers a portion of the wire end case.

16. The printed circuit board layout structure of claim 9, wherein the wire end case is provided with an unblocking snap to be buckled with the board end connector shell.

17. The printed circuit board layout structure of claim 9, wherein two guide pieces are arranged on both sides of the board end connector shell, respectively, and two guide slots are arranged on both sides of the wire end case, respectively.

* * * * *